US006223555B1

(12) United States Patent
Schroeder et al.

(10) Patent No.: US 6,223,555 B1
(45) Date of Patent: May 1, 2001

(54) ACCUMULATOR FOR AN AIR CONDITIONING SYSTEM

(75) Inventors: Fred Georg Schroeder, Grosse Lle; Hemant Sumentlal Shah, Livonia; Jeffrey Paul Luther, Belleville; Kevin Joseph Goulet, Milford; Randy John Hornby, Canton, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/327,440

(22) Filed: Jun. 8, 1999

(51) Int. Cl.[7] ..... F25B 43/00
(52) U.S. Cl. ..... 62/503; 62/474
(58) Field of Search ..... 62/503, 512, 474, 62/475, 509; 29/892.06

(56) References Cited

U.S. PATENT DOCUMENTS

| | | | | |
|---|---|---|---|---|
| 3,858,407 | | 1/1975 | Schumacher . | |
| 4,041,728 | | 8/1977 | Morse et al. . | |
| 4,651,540 | | 3/1987 | Morse . | |
| 5,076,071 | | 12/1991 | Morse . | |
| 5,184,480 | | 2/1993 | Kolpacke . | |
| 5,201,792 | | 4/1993 | Study . | |
| 5,347,829 | * | 9/1994 | Newman | 62/474 |
| 5,398,523 | | 3/1995 | Yoshii et al. . | |
| 5,522,204 | * | 6/1996 | Wood . | |
| 5,596,882 | * | 1/1997 | Hutchison et al. | 62/503 |
| 5,729,998 | | 3/1998 | Grohs et al. . | |
| 5,868,001 | * | 2/1999 | Shoulders | 62/503 |

* cited by examiner

*Primary Examiner*—Corrine McDermott
*Assistant Examiner*—Chen-Wen Jiang
(74) *Attorney, Agent, or Firm*—Larry I. Shelton

(57) ABSTRACT

An accumulator for an air conditioning system of a motor vehicle includes a housing having an interior chamber and an inlet tube connected to the housing to allow refrigerant and oil to enter the interior chamber of the housing. The accumulator also includes an outlet tube connected to the housing to allow refrigerant and oil to exit the interior chamber of the housing and a single insert disposed in the interior chamber of the housing to allow refrigerant liquid/vapor separation, insulation, and oil return.

14 Claims, 3 Drawing Sheets

FIG 3
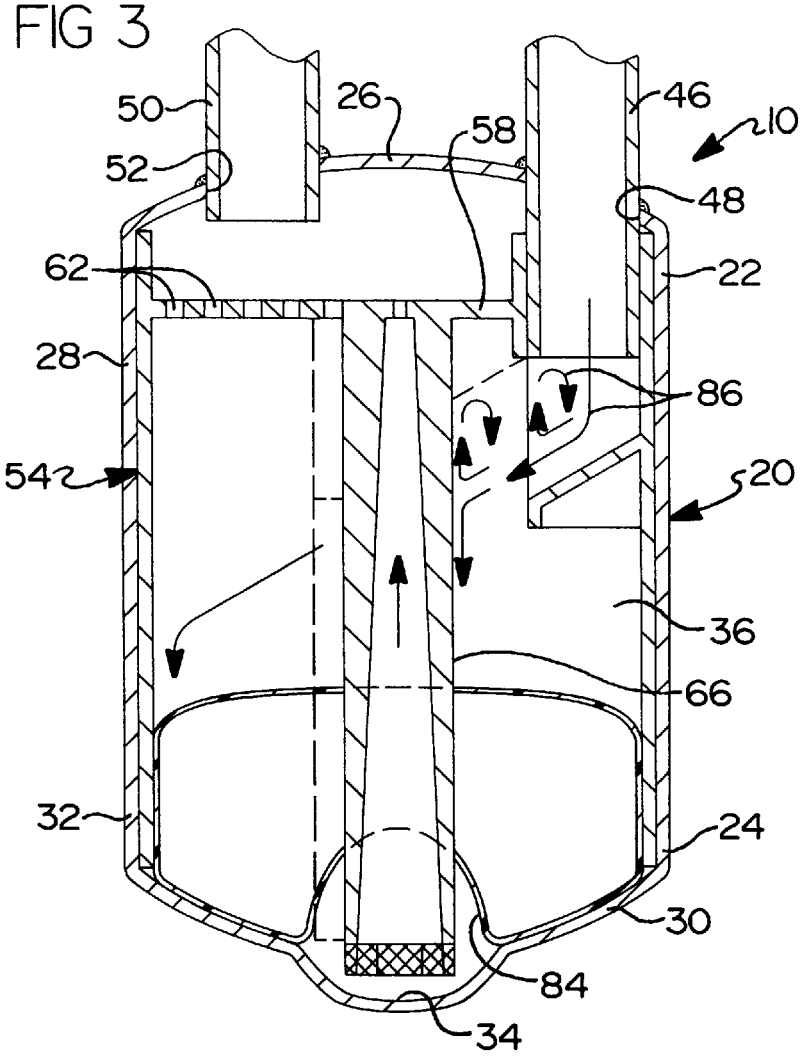
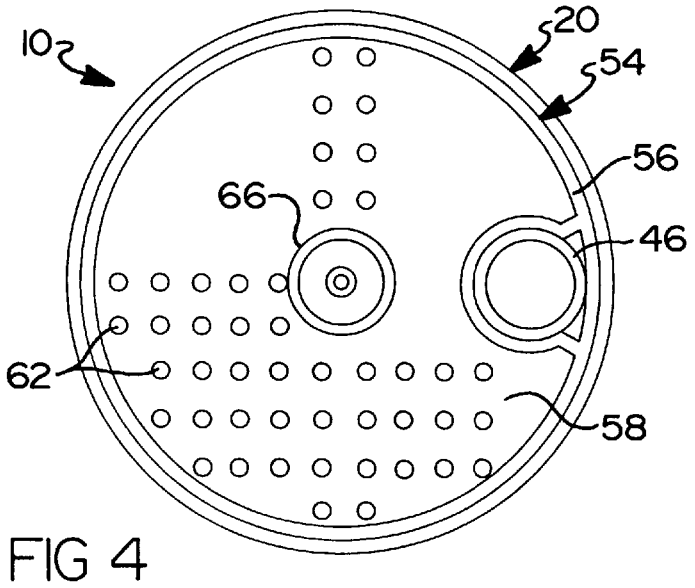
FIG 4

FIG 4A
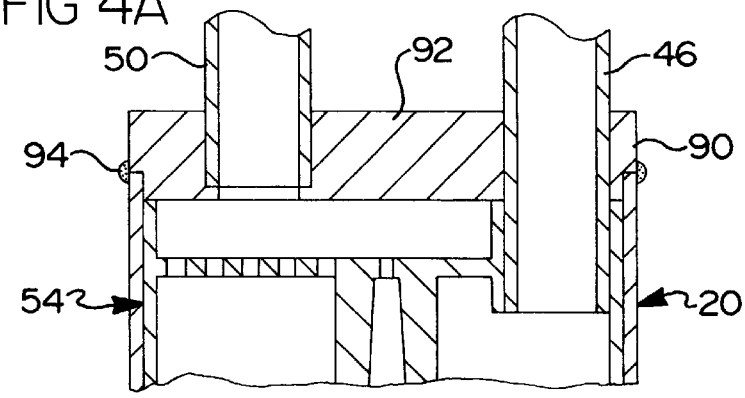
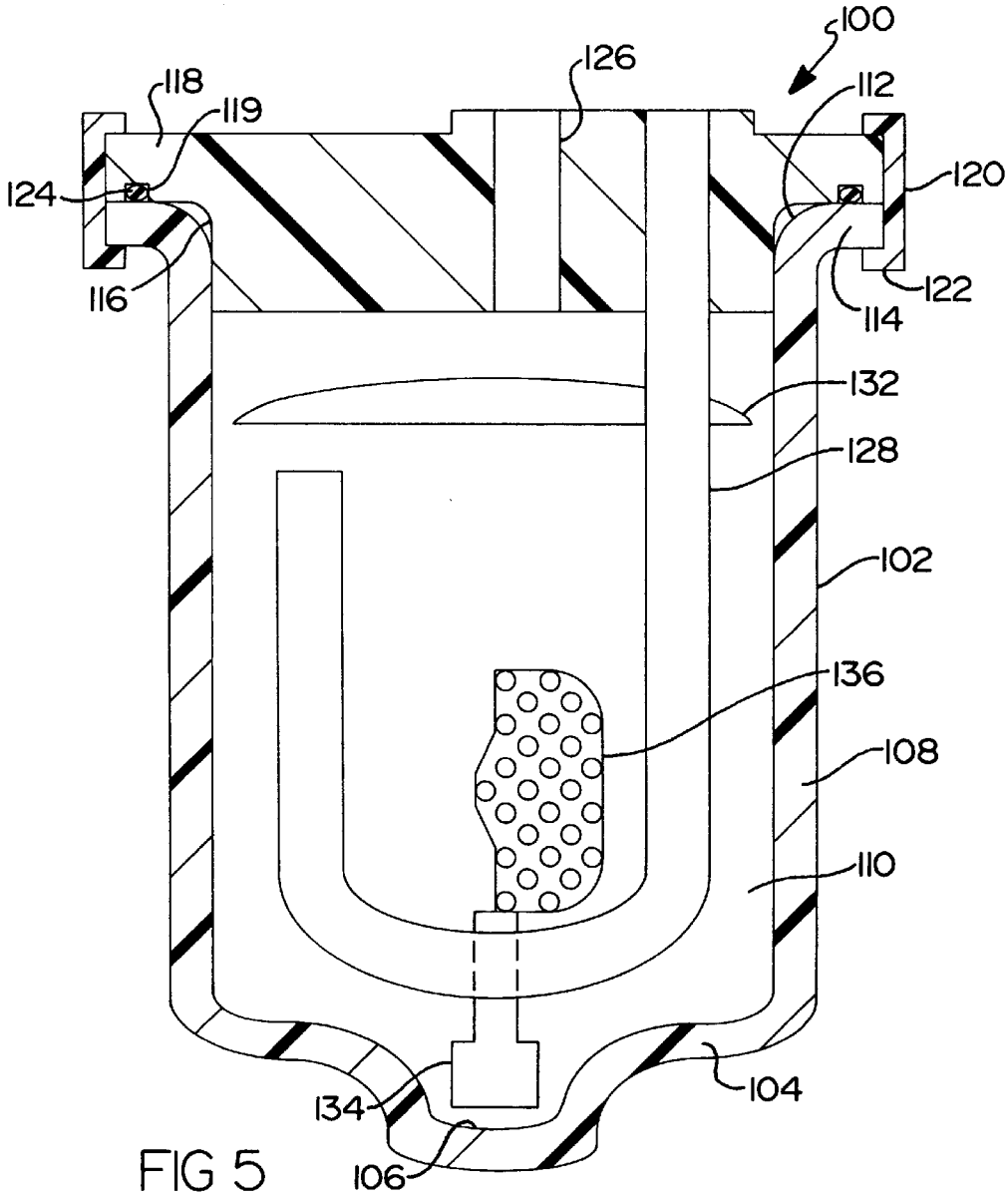
FIG 5

ACCUMULATOR FOR AN AIR CONDITIONING SYSTEM

BACKGROUND OF THE INVENTION

1. Field of the Invention

The present invention relates generally to air conditioning systems for motor vehicles and, more specifically, to an accumulator for an air conditioning system of a motor vehicle.

2. Description of the Related Art

It is known to provide an accumulator for an air conditioning system of a motor vehicle. Examples of such accumulators are disclosed in U.S. Pat. Nos. 5,184,480, 5,201,792 and 5,729,998. Typically, the accumulator includes a housing having a first section and a second section which are joined together to define an interior chamber. The housing also has an inlet opening through which refrigerant may be introduced into the interior chamber and an outlet opening through which refrigerant may exit the interior chamber. The accumulator also includes a separate inlet tube, outlet tube, oil return and desiccant bag disposed in the interior chamber of the housing.

Although the above accumulators have worked well, they suffered from the disadvantage that the housing is made of a metal material, which requires welding. Another disadvantage of these accumulators is that the weld does not allow for serviceability of the accumulators. Yet another disadvantage of these accumulators is that the metal material does not integrate with other parts of the accumulator. A further disadvantage of these accumulators is that they are relatively costly. Therefore, there is a need in the art to provide an accumulator for an air conditioning system that overcomes these disadvantages.

SUMMARY OF THE INVENTION

Accordingly, the present invention is an accumulator for an air conditioning system. The accumulator includes a housing having an interior chamber. The accumulator also includes an inlet tube connected to the housing to allow refrigerant and oil to enter the interior chamber of the housing. The accumulator includes an outlet tube connected to the housing to allow refrigerant and oil to exit the interior chamber of the housing. The accumulator further includes a single insert disposed in the interior chamber of the housing to allow refrigerant liquid/vapor separation, insulation, and oil return.

Also, the present invention is an accumulator for an air conditioning system including a plastic housing having an interior chamber with an open end and a lid disposed adjacent the housing and closing the open end of the interior chamber. The accumulator also includes an inlet tube connected to the lid to allow refrigerant and oil to enter the interior chamber of the housing and an outlet tube connected to the lid to allow refrigerant and oil to exit the interior chamber of the housing.

One advantage of the present invention is that an accumulator is provided for an air conditioning system of a motor vehicle for accumulation of liquid and liquid/vapor separation. Another advantage of the present invention is that the accumulator has a one-piece plastic insert and/or accumulator body, eliminating a welding operation and being serviceable. Yet another advantage of the present invention is that the accumulator has a metal to plastic interface for better part integration. Still another advantage of the present invention is that the accumulator provides improved liquid/vapor separation and insulation to improve air conditioning performance. A further advantage of the present invention is that the accumulator has a new oil return tube to improve lubrication to a compressor of the air conditioning system. Still a further advantage of the present invention is that the accumulator is relatively easy to assemble and less expensive than previous accumulators.

Other features and advantages of the present invention will be readily appreciated, as the same becomes better understood after reading the subsequent description taken in conjunction with the accompanying drawings.

BRIEF DESCRIPTION OF THE DRAWINGS

FIG. 3 is a side view of the accumulator of FIG. 1.

FIG. 4 is a top view of the accumulator of FIG. 1.

FIG. 4A is a side view of an optional top for the accumulator of FIG. 1.

FIG. 5 is a fragmentary view of another embodiment, according to the present invention, of the accumulator of FIG. 1.

DESCRIPTION OF THE PREFERRED EMBODIMENT(S)

Figure 1:
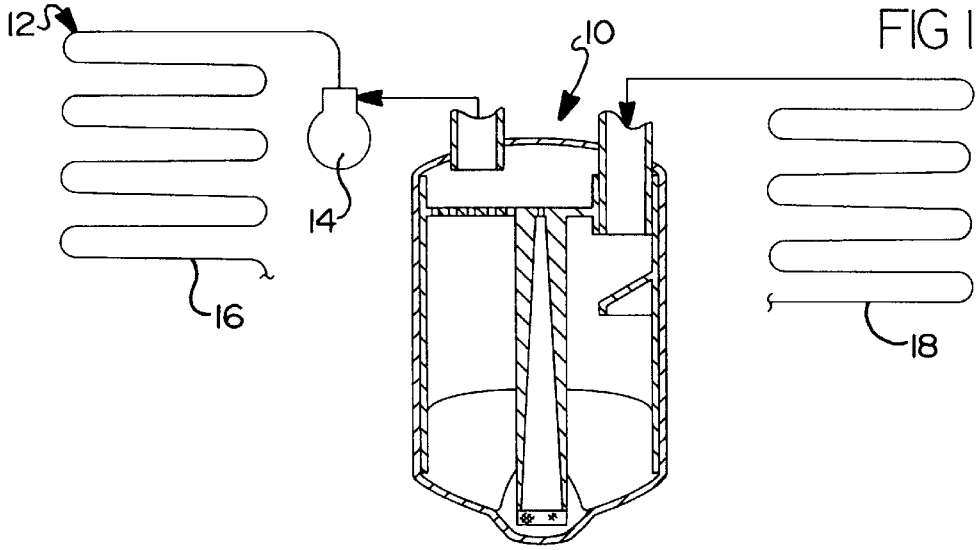
FIG. 1 is a fragmentary view of an accumulator, according to the present invention, illustrated in operational relationship with an air conditioning system of a motor vehicle.

Referring to the drawings and in particular FIG. 1, one embodiment of an accumulator 10, according to the present invention, is illustrated in operational relationship with an air conditioning system, generally indicated at 12, for a motor vehicle (not shown). The air conditioning system 12 includes a compressor 14, a condenser 16 connected to the compressor 14, an evaporator 18 connected to the condenser 16, and the accumulator 10 connected between the evaporator 18 and compressor 14. It should be appreciated that, except for the accumulator 10, the air conditioning system 12 is conventional and known in the art. It should also be appreciated that the accumulator 10 could be used for other air conditioning systems besides motor vehicles.

Figure 2:
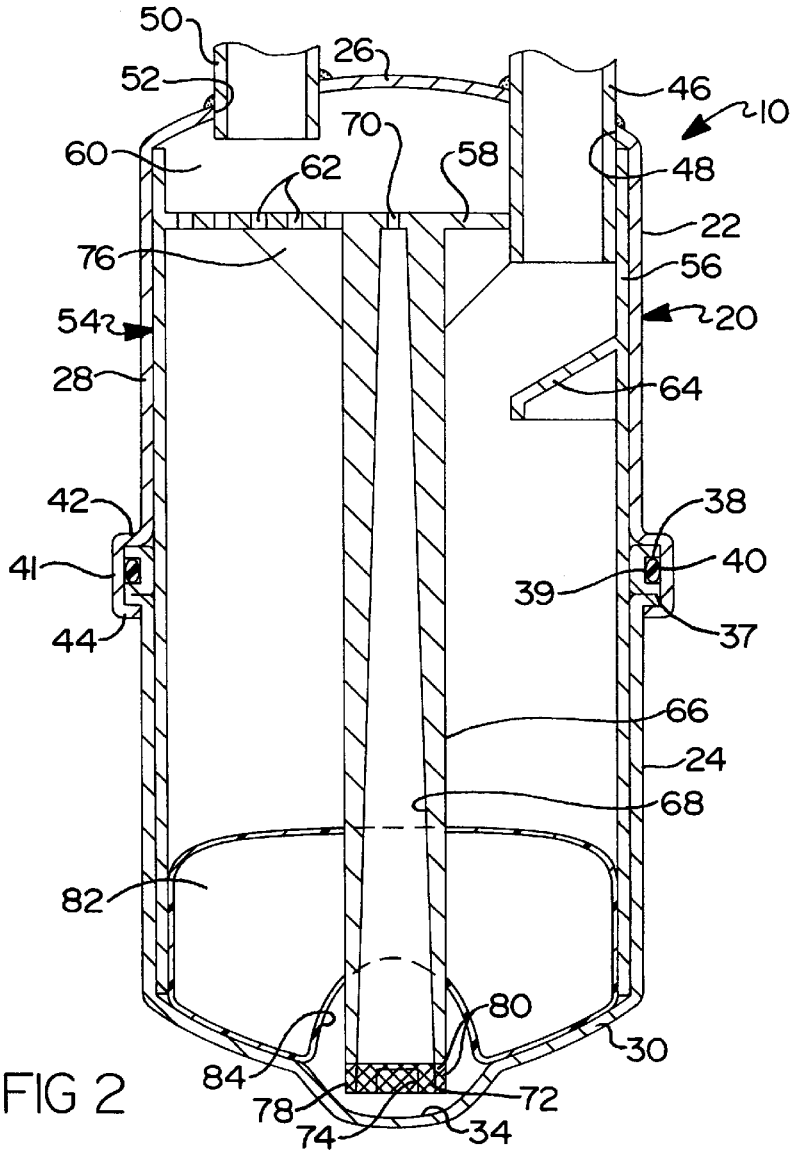
FIG. 2 is an enlarged fragmentary view of the accumulator of FIG. 1.

Referring to FIGS. 2 through 4, the accumulator 10 includes an accumulator body or housing, generally indicated at 20, extending axially. The housing 20 is made of a metal material such as aluminum or steel. The housing 20 includes a first or upper section 22 and a second or lower section 24. The first section 22 includes a top or end portion 26 and a generally cylindrical side wall or body portion 28 extending from the end portion 26. The second section 24 includes a bottom or end portion 30 and a generally cylindrical side wall or body portion 32 extending from the end portion 30. The end portion 30 has a recess 34 centrally located for a function to be described.

The first and second sections 22 and 24 are joined together near or above the middle of the housing 20 to define an interior chamber 36. The second section 24 has a radial fold 37 and a radial flange 38 spaced from the fold 37 and defining a channel 39 to receive a seal 40 such as an O-ring made of an elastomeric material. The first section 22 includes a flange 41 at one end of the body portion 28 spaced radially therefrom by a connecting portion 42. The flange 41 overlaps the flange 38, seal 40 and fold 37 and is radially crimped at 44 over the fold 37 to secure the first section 22 and second section 24 together. The radial crimp 44 and seal 40 avoid damage to internal components of the accumulator 10 due to excessive heat from any welding operations.

The accumulator 10 includes an inlet fitting or tube 46 brazed or otherwise fitted to the housing 20 through an inlet opening 48 formed in the end portion 26 of the first section 22. Liquid and gaseous refrigerant such as freon circulating from the evaporator 18 and through the inlet tube 46 are introduced into the interior chamber 36 through the inlet opening 48. It should be appreciated that the refrigerant may contain oil mixed therewith.

The accumulator 10 also includes an outlet tube 50 brazed or otherwise fitted to the housing 20 and having a free end disposed proximate the end portion 26 of the first section 22. The outlet tube 50 extends from its free end through an outlet opening 52 formed in the end portion 26 of the first section 22.

The accumulator 10 further includes an insert, generally indicated at 54, disposed within the interior chamber 36 of the housing 20 to provide refrigerant liquid/vapor separation, insulation, and oil return. The insert 54 includes a side or body wall 56 extending axially from the end portion 26 to the end portion 34. The body wall 56 is annular in shape. The body wall 56 is disposed between the inlet tube 46 and the body portion 28 of the first section 22.

The insert 54 also includes a top or base wall 58 extending radially and interconnecting the body wall 56 to form a dome area 60 between the base wall 58 and the end portion 26 of the housing 20. The base wall 58 is generally circular in shape and includes at least one, preferably a plurality of apertures 62 extending axially therethrough. The apertures 62 are located near the free end of the outlet tube 50. The apertures 62 "filter out" the liquid refrigerant, allowing only vapor to pass through for a function to be described.

The insert 54 also includes a deflector 64 disposed underneath the inlet tube 46 for the incoming refrigerant. The deflector 64 extends radially a predetermined distance from the body wall 56 and is inclined or sloped toward the end portion 30. The deflector 64 acts to disperse the refrigerant onto the walls of the insert 54, resulting in non-turbulent flow. It should be appreciated that the deflector 64 coupled with the apertures 62 in the base wall 58 of the insert 54, eliminate the need for a separate dome.

The insert 54 includes an oil return 66 extending axially from a center of the base wall 58. The oil return 66 is a hollow tube having a generally circular cross-section. The oil return 66 has an interior wall 68 which is tapered from a smaller outlet 70 extending through the base wall 58 to a larger inlet 72 that terminates a spaced distance from the end portion 30 of the second section 24. The oil return 66 has at least one, preferably a plurality of notches 74 at the inlet 72 having a generally square shape. The notches 74 are spaced about the inlet 72 and guarantee oil flow in the event the oil return contacts the end portion 30 of the second section 24. The taper of the interior walls 68 acts as a self-cleaning mechanism for the oil and may eliminate the need for a filter at the inlet 72 thereof. It should be appreciated that oil mixed with the refrigerant flows from the inlet 72 and through the outlet 70 to the dome area 60 where refrigerant vapor mixes with the oil and is directed to the outlet tube 50 at the top of the accumulator 10.

The insert 54 includes at least one, preferably a plurality of gussets 76 to provide structural support for the oil return 66. The gussets 76 are generally triangular in shape and extend between the oil return 66 and the base wall 58. The gussets 76 are spaced circumferentially about the oil return 66.

Optionally, the insert 54 may include a filter 78 at the inlet 72 of the oil return 66. The filter 78 is a molded screen having a plurality of apertures 80 extending axially therethrough to filter out contaminants.

The insert 54 is made of a plastic material such as Nylon 66 to provide material compatibility with the refrigerant and oil. The insert 54 acts as an insulator to the refrigerant inside and replaces the need for foam insulation on the outside of the accumulator 10. The insert 54 is integral, unitary and molded as one-piece or multiple pieces that are joined. It should be appreciated that the single plastic insert 54 eliminates the need for a separate dome, foam insulation, J-tube, and oil filter.

Optionally, the accumulator 10 may include a desiccant bag 82 disposed in the second section 22 about the oil return 66. The desiccant bag 82 has a slot 84 for liquid flow to oil pickup. It should be appreciated that the desiccant bag 82 is conventional and known in the art.

In operation of the accumulator 10, the refrigerant and oil enter the interior chamber 36 through the inlet tube 46 as indicated by the arrows 86 in FIG. 3. The refrigerant and the oil separate and the refrigerant separates into a liquid and vapor. The oil travels through the oil return 66 to the dome area 60 and the vapor travels through the apertures 62 to the dome area 60. The oil and vapor mix in the dome area 60 and exit through the outlet tube 50. The liquid remains in the interior chamber 36 of the accumulator 10 near the end portion 30 of the housing 20.

Optionally, the accumulator 10 may have a housing 20 with an open end 90 and a top cap 92 closing the open end 90. The insert 54 would be disposed in the interior chamber of the housing 20 and closed with the top cap 92. The top cap 92 is secured to the housing 20 by welds 94. It should be appreciated that the inlet tube 46 and outlet tube 50 are attached to the top cap 92.

Referring to FIG. 5, another embodiment 100, according to the present invention, of the accumulator 10 is shown. The accumulator 100 includes a housing 102 extending axially. The housing 102 is made of a plastic material such as glass reinforced, heat stabilized nylon. The housing 102 includes a bottom or end portion 104 having a recess 106 centrally located. The housing 102 also includes a generally cylindrical side wall or body portion 108 extending from the end portion 104 to form an interior chamber 110 with an open end 112. The housing 102 includes a flange 114 extending radially from the open end 112 of the body portion 108.

The accumulator 100 includes a lid 116 closing the open end 112 of the interior chamber 110. The lid 116 is generally circular in shape and extends axially. The lid 116 has a flange 118 extending radially outwardly to abut or contact the flange 114 of the housing 102. The lid 116 is made of a rigid material such as plastic or metal. The lid 116 has a groove 119 therein for a function to be described.

The accumulator 100 also includes a collar 120 connecting the lid 116 to the housing 102. The collar 120 is generally annular is shape and has an initial "L" shaped cross-section. The collar 120 is disposed about the flanges 114 and 118 and is crimped at 122 over the flanges 114 and 118 to form a solid radial ring with a "C" shaped cross-section. The collar 120 is made of a metal material.

The accumulator 100 includes a seal 124 disposed in the groove 119 between the lid 116 and the housing 102. The seal 124 is an O-ring made of an elastomeric material. The seal 124 creates a seal between the housing 102 and the lid 116 due to a compressive force exerted by the crimped collar 120.

The accumulator 100 also includes an inlet tube 126 to allow refrigerant and oil to enter the interior chamber 110.

The accumulator 100 includes an outlet tube 128 extending through the lid 116 to allow refrigerant and oil to exit the accumulator 100. The outlet tube 128 has a general "J" shape with one end extending through the lid 116. The accumulator 100 further includes a deflector 132 disposed in the interior chamber 110 beneath the inlet tube 126 to deflect the refrigerant and oil entering the accumulator 100 onto the internal walls of the housing 102. The deflector 132 is operatively connected to the outlet tube 128 by the outlet tube 128 extending through the deflector 132. The accumulator 100 includes an oil pick-up 134 connected to the outlet tube 128 to pick up oil from the bottom of the interior chamber 110 and to mix with refrigerant vapor in the outlet tube 128. The accumulator 100 may include a desiccant container or bag 136 disposed in the interior chamber 110 about the outlet tube 128 to remove moisture from the refrigerant. It should be appreciated that the inlet tube 126, outlet tube 128, oil pick-up 134 and desiccant bag 136 are conventional and integrated with the lid 116.

Accordingly, the accumulator 100 is a cost reduction over current accumulators and allows for a serviceable accumulator, since there is no weld, and the metal collar could be modified to latch and unlatch. The accumulator 100 has a plastic housing 102 instead of a metal housing and the weld is replaced with a radial collar 120 and seal 124. The accumulator 100 has a one-piece plastic accumulator housing, a metal to plastic interface, a non-welded housing, and internal components attached to the lid only to be serviceable.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An accumulator for an air conditioning system comprising:

a housing having an interior chamber;

an inlet tube connected to said housing to allow refrigerant and oil to enter said interior chamber of said housing;

an outlet tube connected to said housing to allow refrigerant and oil to exit said interior chamber of said housing; and a single one-piece plastic insert disposed in said interior chamber of said housing to allow refrigerant liquid/vapor separation, insulation, and oil return.

2. An accumulator as set forth in claim 1 wherein said insert is made of a plastic material.

3. An accumulator as set forth in claim 1 wherein said housing is made of a metal material.

4. An accumulator as set forth in claim 1 including a desiccant disposed in said interior chamber.

5. An accumulator for an air conditioning system comprising:

a housing having an interior chamber;

an inlet tube connected to said housing to allow refrigerant and oil to enter said interior chamber of said housing;

an outlet tube connected to said housing to allow refrigerant and oil to exit said interior chamber of said housing;

a single insert disposed in said interior chamber of said housing to allow refrigerant liquid/vapor separation, insulation, and oil return; and wherein said insert has a body wall extending axially and being annular and a base wall extending radially between said body wall to form a dome area of said interior chamber, said outlet tube communicating with said dome area.

6. An accumulator as set forth in claim 5 wherein said base wall has a plurality of apertures to allow refrigerant vapor to enter said dome area.

7. An accumulator for an air conditioning system comprising:

a housing having an interior chamber;

an inlet tube connected to said housing to allow refrigerant and oil to enter said interior chamber of said housing;

an outlet tube connected to said housing to allow refrigerant and oil to exit said interior chamber of said housing;

a single insert disposed in said interior chamber of said housing to allow refrigerant liquid/vapor separation, insulation, and oil return; and wherein said insert includes a deflector disposed beneath said inlet tube to deflect refrigerant and oil onto walls of said insert.

8. An accumulator for an air conditioning system comprising:

a housing having an interior chamber;

an inlet tube connected to said housing to allow refrigerant and oil to enter said interior chamber of said housing;

an outlet tube connected to said housing to allow refrigerant and oil to exit said interior chamber of said housing;

a single insert disposed in said interior chamber of said housing to allow refrigerant liquid/vapor separation, insulation, and oil return; and wherein said insert includes an oil return extending axially to pickup oil from a bottom of said interior chamber and return the oil to mix with refrigerant vapor.

9. An accumulator as set forth in claim 8 wherein said oil return has an interior wall that is tapered.

10. An accumulator as set forth in claim 8 wherein said oil return has a plurality of notches at an end spaced from a bottom of said housing.

11. An accumulator as set forth in claim 8 including a filter at one end of said oil return.

12. An accumulator for an air conditioning system of a motor vehicle comprising:

a housing having an interior chamber;

an inlet tube connected to said housing to allow refrigerant and oil to enter said interior chamber of said housing;

an outlet tube connected to said housing to allow refrigerant and oil to exit said interior chamber of said housing; and a single one-piece plastic insert disposed in said interior chamber of said housing to allow refrigerant liquid/vapor separation, insulation, and oil return and having an integral deflector and oil return.

13. An accumulator for an air conditioning system of a motor vehicle comprising:

a housing having an interior chamber;

an inlet tube connected to said housing to allow refrigerant and oil to enter said interior chamber of said housing;

an outlet tube connected to said housing to allow refrigerant and oil to exit said interior chamber of said housing;

a single plastic insert disposed in said interior chamber of said housing to allow refrigerant liquid/vapor separation, insulation, and oil return and having an integral deflector and oil return; and wherein said insert has a body wall extending axially and being annular, said deflector extending radially from said body wall.

14. An accumulator as set forth in claim 13 wherein said insert has a base wall extending radially between said body wall to form a dome area of said interior chamber and having a plurality of apertures to allow refrigerant vapor to enter said dome area, said outlet tube communicating with said dome area and said oil return extending axially from said base wall.

* * * * *